US007188442B2

(12) United States Patent
Fernandez

(10) Patent No.: US 7,188,442 B2
(45) Date of Patent: Mar. 13, 2007

(54) IRONING DEVICE

(75) Inventor: Juan Fernandez, Towaco, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 22 days.

(21) Appl. No.: 10/896,604

(22) Filed: Jul. 21, 2004

(65) Prior Publication Data

US 2005/0278989 A1 Dec. 22, 2005

Related U.S. Application Data

(63) Continuation-in-part of application No. 10/831,923, filed on Apr. 26, 2004.

(51) Int. Cl.
*D06F 75/38* (2006.01)
*D06F 75/30* (2006.01)

(52) U.S. Cl. ..... 38/81; 38/93; 38/97

(58) Field of Classification Search ..... 38/75, 38/81, 88, 93, 94, 97; 132/224, 225, 271; 219/228, 229, 243, 245
See application file for complete search history.

(56) References Cited

U.S. PATENT DOCUMENTS

| | | | | | |
|---|---|---|---|---|---|
| 984,673 | A | * | 2/1911 | House | 38/71 |
| 1,584,974 | A | * | 5/1926 | Bradbury | 132/225 |
| 1,836,045 | A | * | 12/1931 | Siers | 132/118 |
| 2,076,614 | A | * | 4/1937 | Bowman | 38/74 |
| 2,601,059 | A | * | 6/1952 | Rotheraine | 38/69 |
| 2,736,789 | A | | 2/1956 | Cornellier | |
| 2,792,977 | A | * | 5/1957 | Regina | 223/36 |
| 3,074,192 | A | * | 1/1963 | Smith | 38/93 |
| 3,577,859 | A | | 5/1971 | Davidson | |
| 3,811,208 | A | | 5/1974 | Vieceli et al. | |
| 4,196,340 | A | | 4/1980 | Evans, Jr. et al. | |
| 4,219,724 | A | | 8/1980 | Allvin | |
| 4,577,424 | A | * | 3/1986 | Liu | 38/88 |
| 4,636,613 | A | * | 1/1987 | de la Morandiere et al. | 219/249 |
| 4,817,309 | A | * | 4/1989 | Frank et al. | 38/15 |
| 5,414,945 | A | | 5/1995 | Freeman et al. | |
| 5,526,596 | A | | 6/1996 | Bitzel et al. | |
| 5,664,588 | A | | 9/1997 | Berry | |
| 5,721,418 | A | | 2/1998 | Hazan et al. | |
| 5,732,489 | A | | 3/1998 | Udelle et al. | |
| 5,901,481 | A | | 5/1999 | Simmons et al. | |
| 5,934,293 | A | | 8/1999 | Kaizuka | |
| 5,957,140 | A | | 9/1999 | McGee | |
| 6,119,702 | A | | 9/2000 | Habibi | |

(Continued)

OTHER PUBLICATIONS

Website Description of Steam 'N Press from www.rowentausa.com, printed on Apr. 5, 2004.
Linens-N-Things Website Description of Euro Pro Shark Steamer/Iron, printed Nov. 14, 2003.

*Primary Examiner*—Ismael Izaguirre
(74) *Attorney, Agent, or Firm*—Lerner, David, Littenberg, Krumholz & Mentlik, LLP

(57) ABSTRACT

A handheld iron for pressing or creasing an article of fabric without the use of an ironing board. The handheld iron having a housing, a platform, and an actuator for displacing the platform with respect to the housing. The housing further includes a heating surface and the platform further includes a platform surface. The heating surface and the platform surface are in substantially parallel planes at all times, including when the platform is displaced with respect to the housing.

27 Claims, 10 Drawing Sheets

U.S. PATENT DOCUMENTS 6,173,718 B1 1/2001 Okumoto et al.
6,216,369 B1 4/2001 Wolf et al.
6,243,976 B1 6/2001 Beverly et al.
6,260,295 B1 * 7/2001 Nickel ..... 38/79
6,325,072 B1 12/2001 Smetana
6,421,939 B1 7/2002 David et al.
6,494,216 B1 12/2002 Hirata
6,513,269 B2 2/2003 Kobayashi et al.
6,539,651 B1 4/2003 Rius et al.
6,625,910 B2 9/2003 Ching et al.
2001/0030183 A1 10/2001 Bowen
2002/0190047 A1 12/2002 Nam

* cited by examiner

IRONING DEVICE

CROSS-REFERENCE TO RELATED APPLICATIONS

This application is a continuation-in-part application of application Ser. No. 10/831,923 filed on Apr. 26, 2004.

FIELD OF THE INVENTION

The present invention relates to handheld devices for pressing or creasing fabric.

BACKGROUND OF THE INVENTION

The iron is one of the most widely owned and used household appliances. Since its introduction, the typical household iron has solved the problem of wrinkled attire for many a person. With advances such as steam production and thermostats, the iron has become more versatile as well as easier to use. However, there still exists those users and those particular jobs for which even the most technologically advanced irons are not proper.

One major drawback to the conventional household iron is that it requires a hard flat surface to support the garment or other fabric article to be pressed. Normally, an ironing board is the clear choice for such a surface. However, ironing boards take up significant space and may not be appropriate for all types of jobs. Often, when ironing boards are not available, flat surfaces such as those on tables or counter tops are utilized. However, pressing an article on a surface not particularly suited for use with a heated iron brings with it the possibility that the surface or the fabric article can be damaged.

Another drawback to the conventional household iron lies within the realm of hanging fabric articles. All too frequently, drapes in a house become wrinkled and detract from the aesthetic beauty of the decorum. With the pressing of articles such as these, the battle lies both in removing them from their vertical mounting and in manipulating their sheer size. Similarly, providing creases in the desired locations can be an overwhelming task.

Attempts have been made to improve upon the conventional household iron. For example, the prior art shows a hand tool for pressing garments. This device is essentially a handheld iron with a pivotably attached surface portion which can be pivoted into contact with a heated sole plate through actuation of a handle. In use, a piece of fabric is placed between the surface portion and the sole plate. The surface portion is then pivoted to capture the fabric between the surface portion and the sole plate. While the device taught in the prior art is useful, it has several drawbacks. For example, the pivotable nature of the connection between the surface portion and the sole plate greatly limits the displacement between the two elements at the rear or connection point and axiomatically limits the amount of fabric that can be inserted between them. The pivotable connection also prevents uniform pressing from occurring over a distance of fabric. Furthermore, prior art devices of this type do not teach combining a steam generating apparatus with the iron.

Therefore, there exists a need for a small, handheld iron which allows for the uniform pressing of fabric articles without an ironing board. A device of this type is useful in many circumstances including traveling or the pressing of hanging fabric articles.

SUMMARY OF THE INVENTION

A first aspect of the present invention is a handheld ironing device comprising a body portion having a substantially flat body surface and a platform having a substantially flat platform surface. The platform surface is moveably associated with the body portion such that the platform surface opposes the body surface and such that the body surface and the platform surface remain in substantially parallel planes throughout movement of the platform with respect to the body portion.

In some embodiments, the ironing device further includes an actuator for moving the platform with respect to the body portion. The actuator is associated with the body portion and the platform to move the platform between a close position at which the platform is closely juxtaposed to or touching the body surface and an open position at which the platform is separated from the body surface sufficiently to allow insertion of fabric between the platform and the body surface. The actuator includes a trigger, a spring, and a gear assembly which are assembled to maintain the platform in an initial position. In one embodiment, the initial position is an open position that allows for fabric to be placed between the platform and body surface. In another embodiment, the initial position is a closed position at which the platform is closely juxtaposed to or touching the body surface.

In some embodiments, the actuator is removable from the body portion. In other embodiments, both the actuator and platform are removable from the body portion. The handheld ironing device may include a removable brush attachment that may be connected to the body portion upon removal of the actuator and the platform.

In certain embodiments of the present invention, on of the body surface or platform surface is a heating surface. In one embodiment, the body surface is a heating surface and the body portion further includes a heating element adapted to transfer heat to the heating surface. In this embodiment, the heating surface may be a sole plate. The handheld ironing device may further include a thermostat for controlling the temperature of the heating surface and a water reservoir for providing water to the heating element to facilitate the production of steam. Water may be selectively provided to the heating element.

Another embodiment of the present invention is a handheld ironing device comprising a housing including an elongate handle portion, a heating element disposed with the housing, a substantially flat sole plate forming an exterior surface of the housing (the heating element transferring heat to the sole plate), a gear assembly removably attached to the housing, a platform having a substantially flat platform surface connected to the gear assembly, and a trigger associated with the gear assembly. The trigger is capable of operating in conjunction with the gear assembly to displace the platform with respect to the housing. In this embodiment, the sole plate and the platform surface are initially in substantially parallel planes and displacement of the platform with respect to the sole plate is in a direction substantially perpendicular to the parallel planes.

Another embodiment of the present invention is a handheld ironing device comprising a body portion including a substantially flat heating surface, a platform having a substantially flat platform surface, and an actuator connecting the body portion to the platform and facilitating movement of the platform with respect to the body portion. The platform is coupled to the body portion such that the platform surface opposes the heating surface. In this embodiment, the movement of the platform with respect to the body portion provides substantially uniform pressure to an article disposed between the heating surface and the platform surface.

Yet another embodiment of the present invention is a handheld ironing device comprising a body portion having a substantially flat heating surface and a platform having a substantially flat platform surface. The platform is movably associated with the body portion such that the platform surface is substantially parallel to the heating surface when the surfaces are closely juxtaposed or when the surfaces touch.

Yet another embodiment of the present invention is a handheld ironing device comprising a body portion having a body surface, a platform having a platform surface and a liquid container for facilitating the production of a gas. The platform movably associated with the body portion such that the platform surface opposes the body surface.

Yet another embodiment of the present invention is a handheld ironing device comprising a body portion having a heating surface, a platform having a platform surface, and an actuator for moving the platform with respect to the body portion. In this embodiment, the platform and the actuator are capable of being removed form the body portion.

A second aspect of the present invention is a method of removing wrinkles from fabric. This method includes the steps of providing a handheld ironing device having a heating surface and a platform surface opposed to the heating surface, situating a fabric article between the heating surface and the platform surface, and moving the platform and heating surfaces together to press the fabric article with substantially uniform pressure between the heating surface and the platform surface. This method may further include the step of heating the heating surface to a desired temperature. The moving step may further include actuating and actuator to move the platform surface with respect to the heating surface. The method may also further include the steps of producing steam and removing lint or other debris from an article of fabric.

BRIEF DESCRIPTION OF THE DRAWINGS

The present invention will be better understood in reading the following detailed description of preferred embodiments which are only examples of the invention herein, the detailed description to be taken together with the drawings of preferred embodiments, in which.

DETAILED DESCRIPTION

Figure 1:
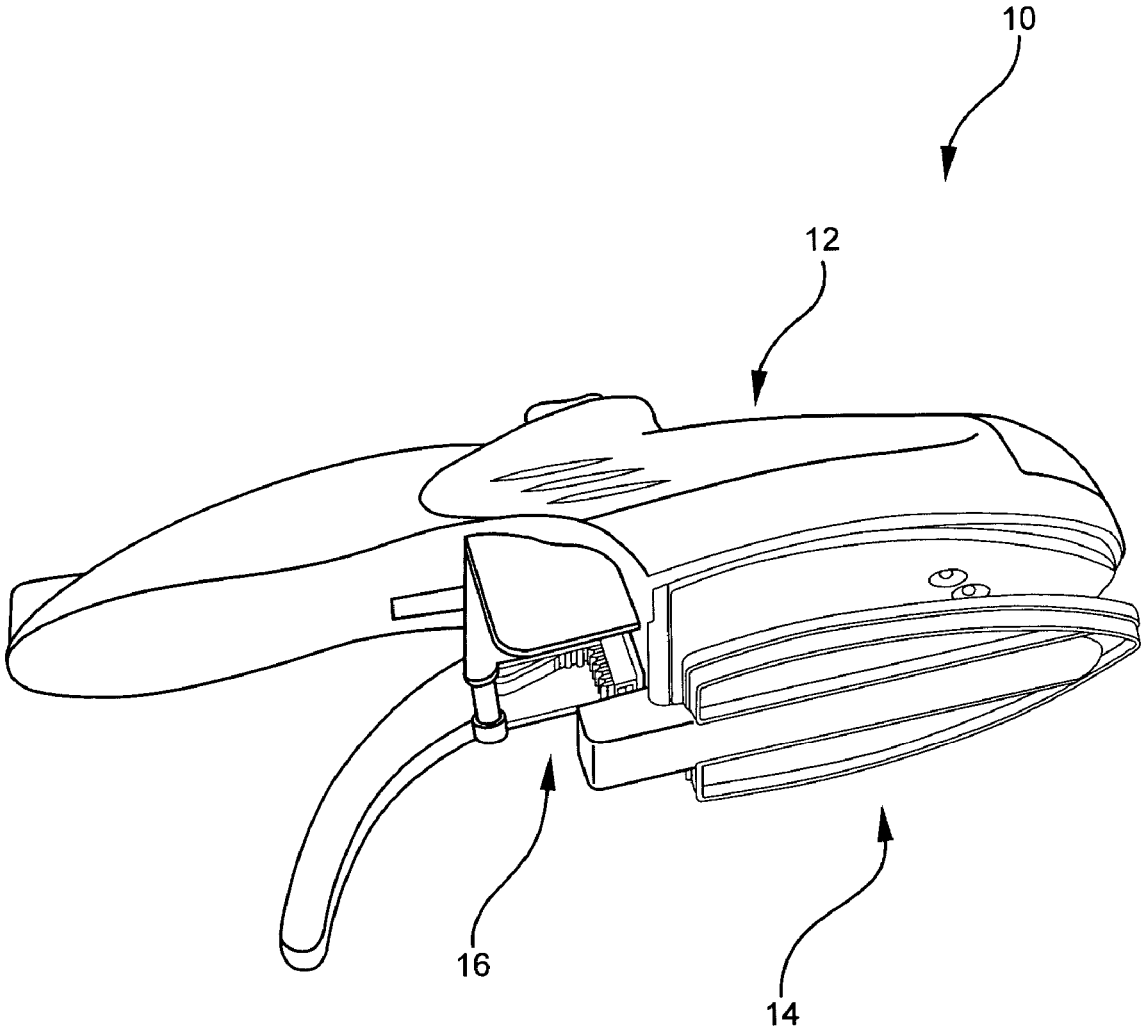
FIG. 1 is a bottom perspective view of the apparatus according to an embodiment of the present invention in an open position.

In describing the preferred embodiments of the subject matter illustrated and to be described with respect to the drawings, specific terminology will be used for the sake of clarity. However, the invention is not intended to be limited to any specific terms used herein, and it is to be understood that each specific term includes all technical equivalents which operate in a similar manner to accomplish a similar purpose.

Referring to the drawings, wherein like reference numerals represent like elements, there is shown in FIGS. 1–12, in accordance with embodiments of the present invention, a handheld pressing device, or iron, designated generally by reference numeral 10. In the preferred embodiment, iron 10 is designed to be used in pressing or creasing articles of fabric and includes a base portion or housing 12, a platform 14, and an actuator 16, which connects platform 14 to housing 12. The preferred iron 10 allows for an article of fabric to be pressed (i.e.—to remove wrinkles) or creased without the use of an ironing board. However, it should be noted that in some embodiments, platform 14 is removably attached to housing 12 and in these embodiments, with platform 14 removed, it is possible to utilize iron 10 with an ironing board (not shown) or in any other manner a conventional iron can be utilized. In operation, the preferred iron 10 can be employed to press various types of fabric material. For example a non-exhaustive list of fabrics includes cotton, rayon, polyester, Lycra, and wool.

Figure 2:
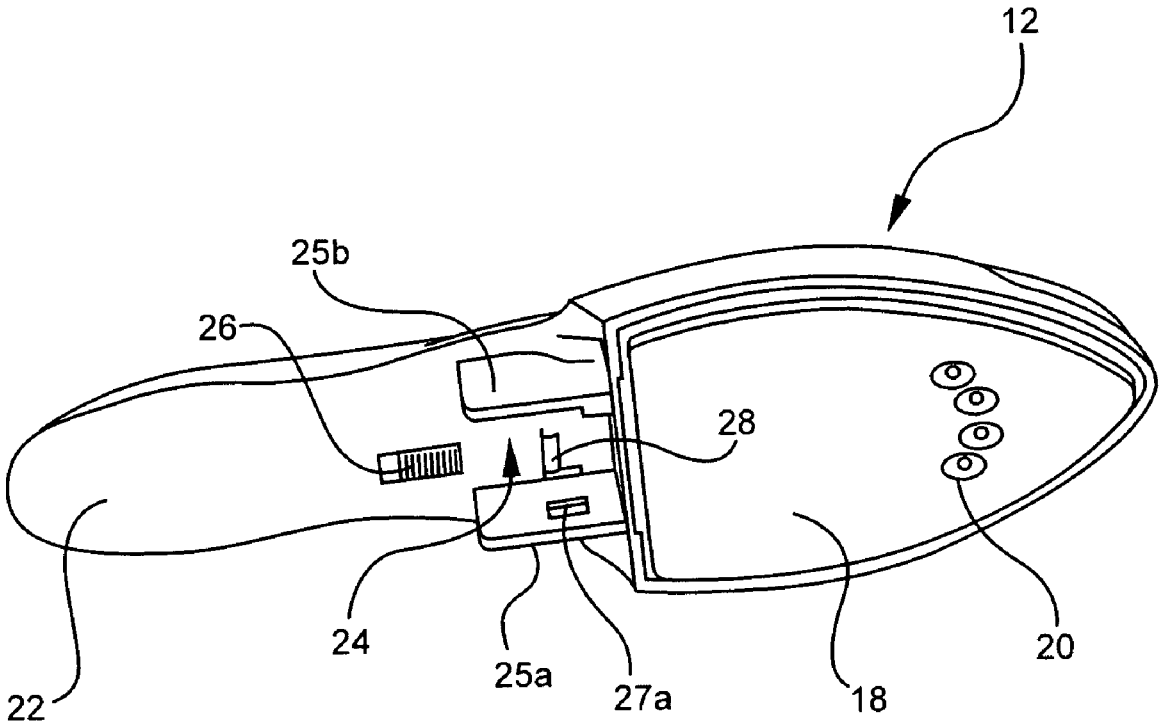
FIG. 2 is a bottom perspective view of the housing according the embodiment of FIG. 1 with the platform removed.
Figure 3:
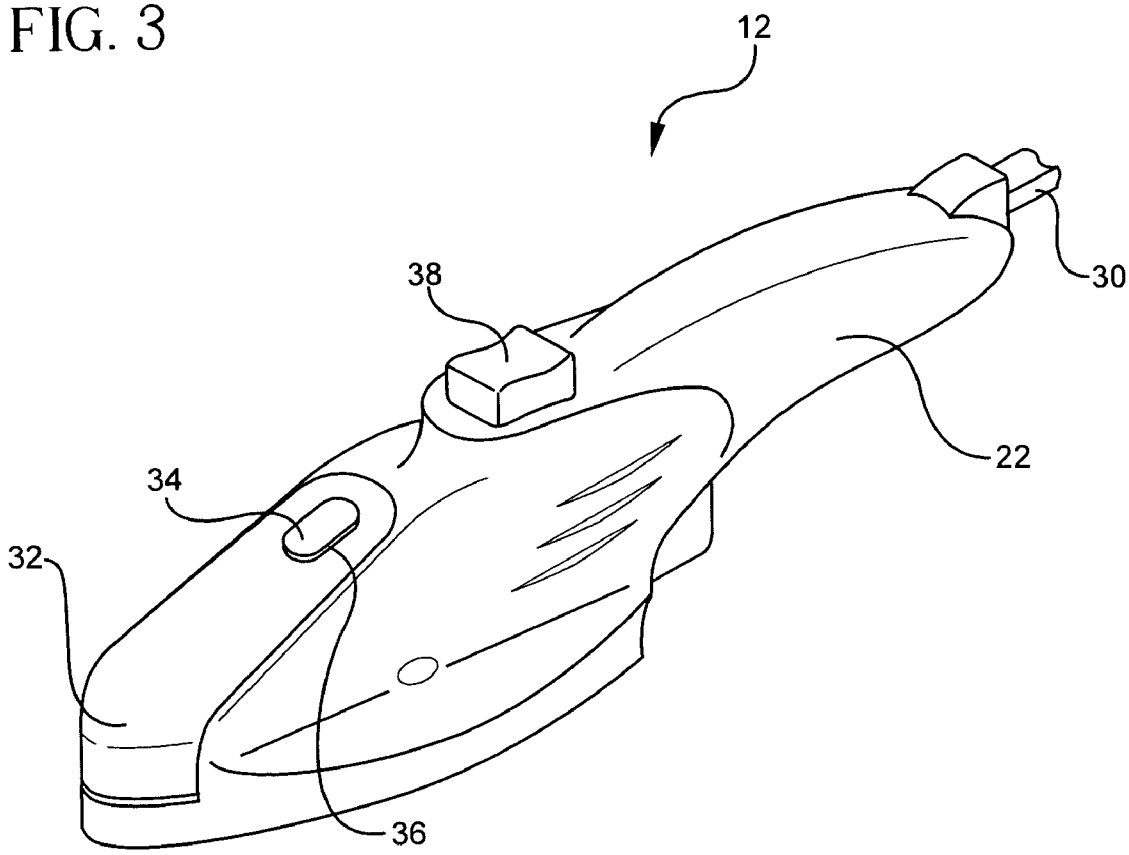
FIG. 3 is a top perspective view of the housing according to the embodiment of FIG. 1 with the platform removed.

FIGS. 2 and 3 show housing 12 without platform 14 connected thereto. Housing 12 includes sole plate or heating surface 18 forming an exterior surface of housing 12, elongated handle 22, slot 24 located adjacent sole plate 18 and defined by side walls 25*a* and 25*b*, power cord 30 connected with elongated handle 22, reservoir 32 located on a surface opposite sole plate 18, and button 38 located between reservoir 32 and elongated handle 22. Sole plate 18 is a standard sole plate, as is well known in the art. In the preferred embodiment, sole plate 18 is constructed of an aluminum material, but in other embodiments can be any type of material suitable for conducting heat to a fabric material, such as iron or steel. In the preferred embodiment, sole plate 18 is heated by a heating element (not shown) disposed within housing 12. One example of a heating element is a heat conducting wire cast within sole plat 18, which upon application of an electric current, heats to higher temperature. Sole plate 18 further includes apertures 20 which work in conjunction with reservoir 32 in the production of steam. This steam production will be discussed more fully below.

Housing 12 also includes elongated handle 22 for allowing the easy gripping and manipulation of iron 10, and power cord 30 for supplying power to the aforementioned heating element. It should be noted that in other embodiments elongated handle 22 can be of any shape or size, which can include ergonomic designs that are constructed to better facilitate grabbing by a user. It is also contemplated that power cord 30 can be of any length and can be engaged with an appropriate power supply, including standard electrical outlets. Furthermore, it is also contemplated that power cord 30 can be constructed so that it is retractable or disposed of within housing 12. Finally, in other embodiments of the present invention iron 10 may not include power cord 30. In these embodiments, iron 10 would include other means of providing the electrical power needed to properly operate the heating element. For example, iron 10 may be adapted to operate with the use of rechargeable or lithium batteries.

As best shown in FIG. 3, housing 12 includes reservoir 32 and button 38. As previously mentioned, reservoir 32 works in conjunction with apertures 20 of sole plate 18. The aforementioned heating element is configured and situated so that liquid from reservoir 32 can come within close proximity of the heating element, thereby allowing such liquid to be heated to its boiling point. The gaseous liquid, in most cases steam, is then allowed to escape from apertures 20. In operation reservoir 32 is filled by introducing water or another suitable liquid through reservoir opening 36. Upon suitable filling, reservoir cap 34 is placed over reservoir opening 36 so that no liquid can escape. Button 38 is selectively depressed, thereby operating a mechanical pumping device (not shown) and allowing liquid to be pumped from reservoir 32 towards the heating element. Upon being rendered gaseous, the liquid escapes through apertures 20 and away from iron 10. Such gas may aid in the pressing and/or removal of debris from a fabric. In the preferred embodiment, the preferable liquid is water and hence, the preferable gas is steam. It is preferred that a user may selectively produce such steam by selectively depressing button 38. However, it is contemplated that other modes of producing and controlling the amount of gas can be utilized. For example, a constant level of steam can be produced without the selective operation by a user.

Figure 4:
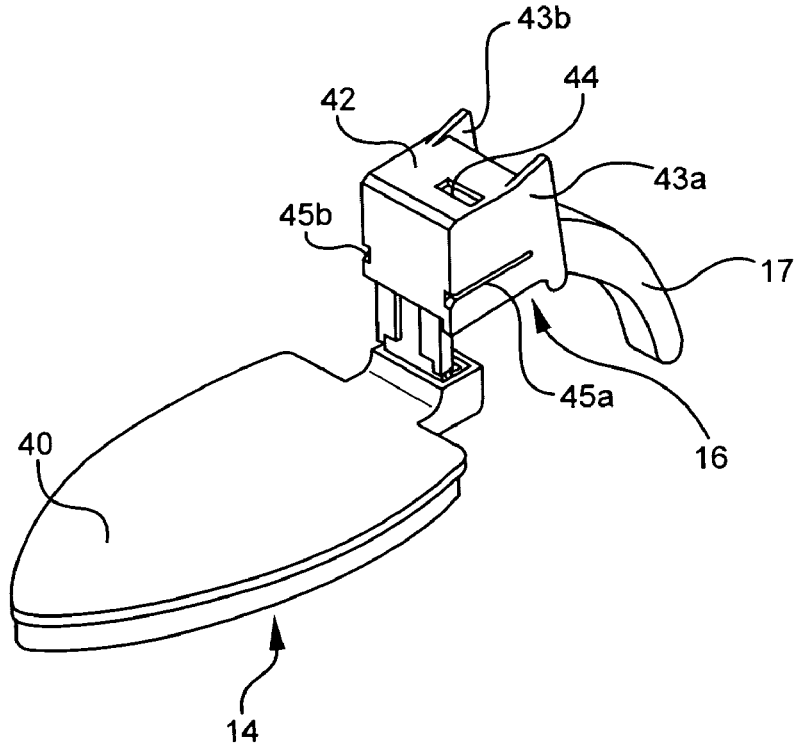
FIG. 4 is a top perspective view of the platform and actuator according to the embodiment of FIG. 1 removed from the housing.

FIG. 4 shows platform 14 and actuator 16 removed from housing 12. Platform 14 includes platform surface 40 which opposes sole plate 18 in the fully constructed iron 10. The movement of platform surface 40 with respect to sole plate 18 captures any fabric disposed in between to be clamped therein. Actuator 16 includes gear box 42 and trigger 17 connected to gear box 42. Platform 14 is connected to actuator 16 at gear box 42, and gear box 42, along with trigger 17, provide the mechanisms needed to generate the relative movement of platform surface 40 with respect to sole plate 18. In a preferred embodiment, platform 14 is constructed from a polymeric material. However, it is contemplated that other materials can be utilized. For example, in other embodiments of the present invention, platform surface can be constructed or coated with a material more suitable to be positioned adjacent a heated sole plate 18. It is also contemplated that platform 14 can include an additional element which can be attached to platform surface 40 to protect the material of platform 14 from heat damage, such as a heat resistant cloth covering.

Figure 5:
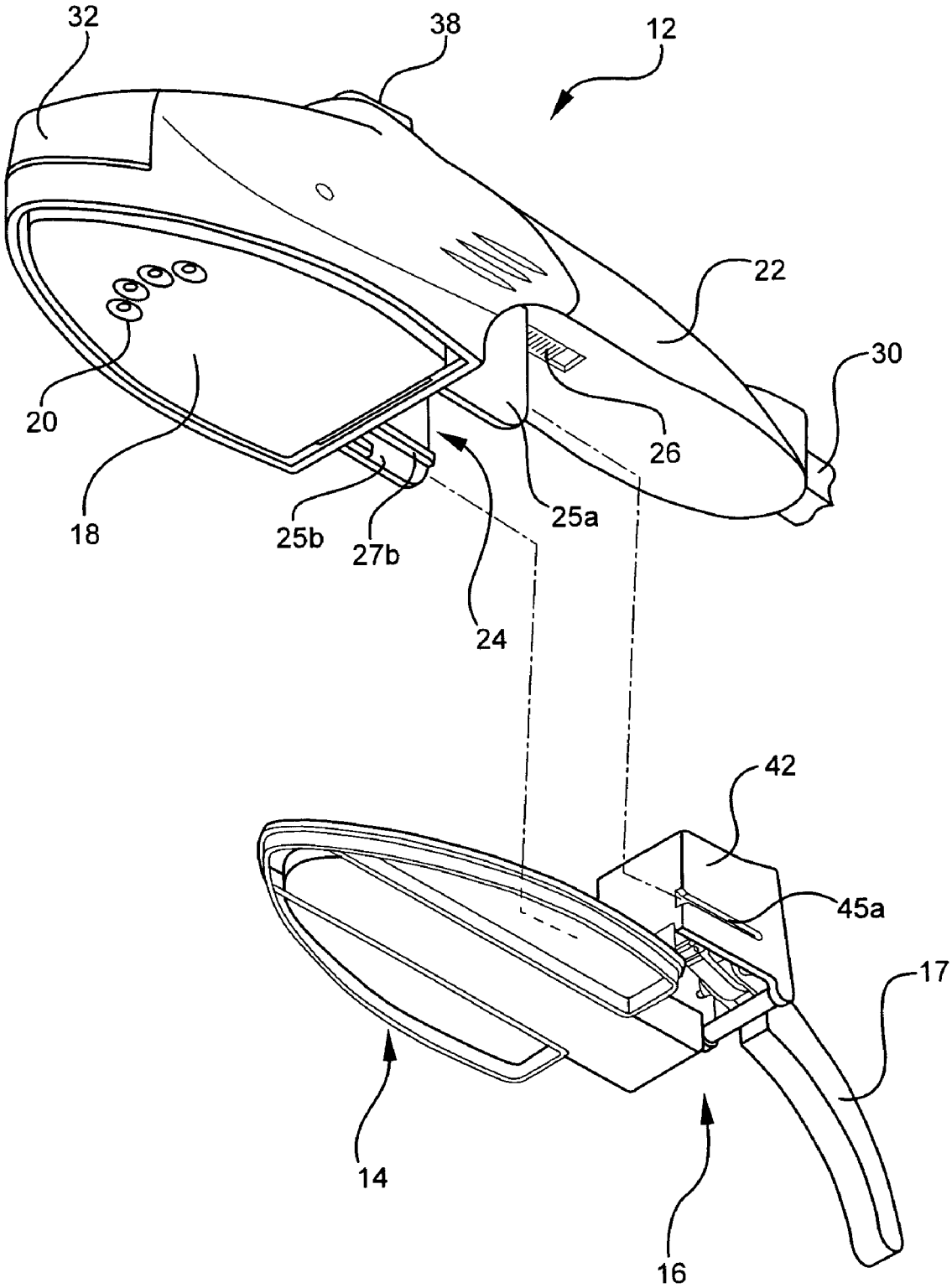
FIG. 5 is an exploded bottom perspective view of the housing, platform, and actuator according to the embodiment of FIG. 1.

Actuator 16 also includes groove 44 and lateral guides 45*a* and 45*b*, located on gear box walls 43*a* and 43*b* which define the exterior of gear box 42 (best shown in FIG. 4). Groove 44 mates with finger 28, located within slot 24 of housing 12 (best shown in FIG. 2) and elongated openings 45*a* and 45*b* mate with extensions 27*a* and 27*b* (best shown in FIGS. 2 and 5 of housing 12. In operation, which is depicted in FIG. 5, gear box 42 slides within slot 24, thereby connecting actuator 16 with housing 12. The coupling between extensions 27*a* and 27*b* with lateral guides 45*a* and 45*b*, respectively, prevents movement of actuator 16 from housing 12 in a direction substantially perpendicular to the plane of platform surface 40. Upon the complete coupling of gear box 42 within slot 24, finger 28 engages groove 44. This engagement locks actuator 16 and housing 12 together and assures that disconnection will not occur thereafter. Switch 26 (best shown in FIG. 2) is also located on housing 12 and is in connection with finger 28. Movement of switch 26 provides relative movement of finger 28. When disconnection of actuator 16 from housing 12 is desired, switch 26 is slid from a first or locked position to a second or unlocked position, thereby moving finger 28 from an extended position to a retracted position. In its retracted position, finger 28 disengages groove 44 and allows for gear box 42 to be slid out of slot 24. It is contemplated that the various components of the mating system between actuator 16 and housing 12 can vary, including the sizes and configurations of the components. Groove 44 may be located at any position on gear box 42 as long as it may correspond and engage with finger 28. Similarly, lateral guides 45*a* and 45*b* may be located at any position on gear box walls 43*a* and 43*b*, as long as they correspond and engage extensions 27*a* and 27*b*.

Figure 6:
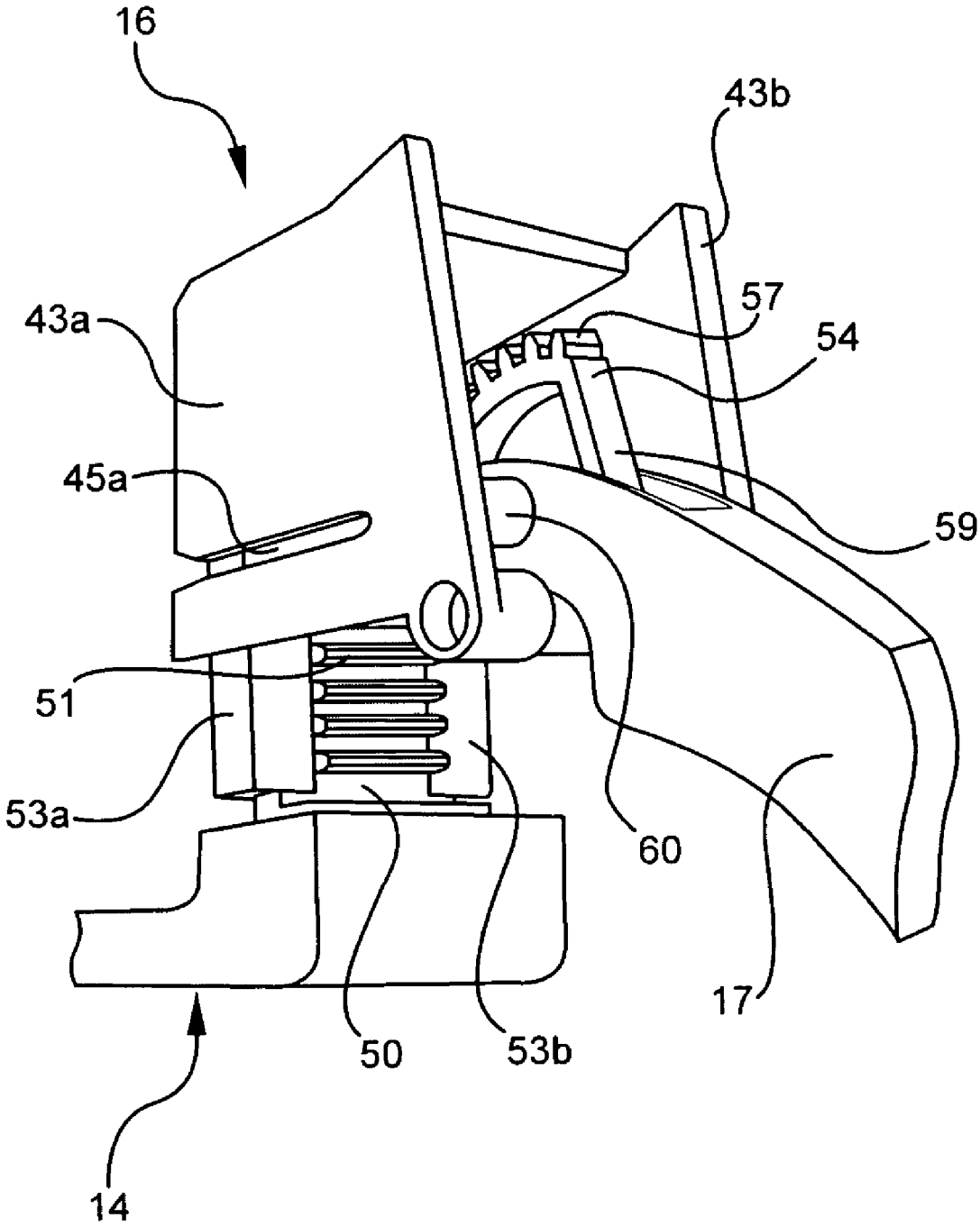
FIG. 6 is an enlarged perspective view of the actuator according to the embodiment of FIG. 1.
Figure 7:
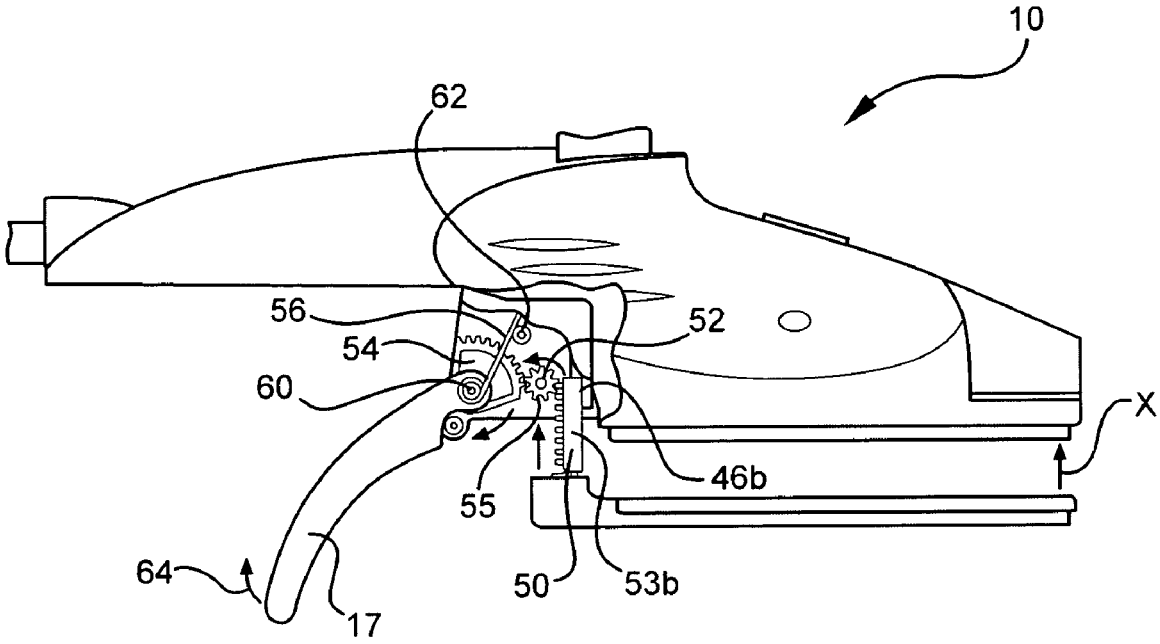
FIG. 7 is a side view, in section, of the apparatus according to the embodiment of FIG. 1 in an opened position.
Figure 8:
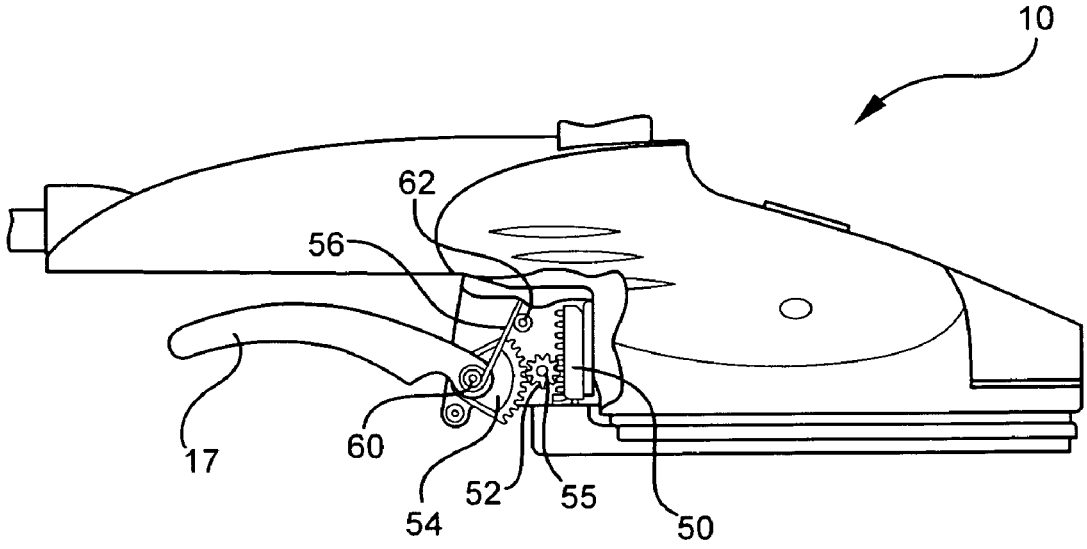
FIG. 8 is a side view, in section, of the apparatus according to the embodiment of FIG. 1 in a closed position.

FIGS. 6–8 more closely detail gear box 42 and its cooperation with trigger 17. As shown in the figures, gear box 42 is defined by gear box walls 43*a* and 43*b*, and includes first gear 50, transition gear 52, second gear 54, and spring 56 (best shown in FIGS. 7 and 8. Gear box walls are attached together, to form an enclosure, by conventional means, such as screws or adhesive. However, other attachment means, as well as forming a single integral housing are also contemplated. First gear 50 is an elongated member having a teeth portion 51 for engaging transition gear 52, and rails 53*a* and 53*b* for facilitating movement of first gear 50. Rails 53*a* and 53*b* cooperate with respective channels 46*a* and 46*b* of gearbox walls 43*a* and 43*b*. This cooperation allows first gear 46 to translate in a linear direction with respect to channels 46*a* and 46*b*. First gear 50 is connected to platform 14 at one end of platform surface 40. In the preferred embodiment, this connection is accomplished through the use of screws, but it should be noted that other connections are also contemplated.

Teeth portion 51 of first gear 50 mates with transition gear 52. Transition gear 52 is a circular gear which rotates about a transition gear pivot 55 extending between gear box walls 43*a* and 43*b*. Second gear 54 is a semi-circular gear having a teeth portion 57, which also mates with transition gear 52, and non-teeth portion 59 connected to trigger 17. Trigger pivot 60 is the connection at which trigger 17 and second gear 54 are pivotably connected to gear box 42. Trigger pivot 60 extends between gearbox walls 43*a* and 43*b* and allows for trigger 17 to rotate around an axis extending through trigger pivot 60. Finally, spring 56 is connected to and biases trigger 17 at trigger pivot 60. Spring 56 is a torsion spring having two ends, one end connected to trigger 17 and the other end contacting cylindrical member 62, which extends between gear box walls 43*a* and 43*b*. A force in direction 64 applied to trigger 17 causes spring 56 to coil and build up energy. Upon the removal of the force applied to trigger 17, spring 56 uncoils and returns trigger 17 to its initial position.

In operation, upon the application of a force, trigger 17 is rotated about trigger pivot 60, which axiomatically displaces second gear 54. This displacement of second gear 54 causes teeth portion 57 to contact transition gear 52 and cause such to rotate. In turn, transition gear 52 contacts teeth portion 51 of first gear 50. Upon contact, and through further movement of second gear 54 and transition gear 52, first gear 50 translates. As mentioned above, this translation occurs in a linear direction with respect to channels 46*a* and 46*b*. In turn, platform 14 translates in a similar direction. As was also detailed above, when a force is no longer applied to trigger 17, spring 56 uncoils and biases trigger 17 back into an initial position, thereby bringing second gear 54, transition gear 52, first gear 50, and platform 14 back into their initial positions. This operation can be performed successively.

In the preferred embodiment, platform surface 40 lies within a plane that is substantially parallel to the plane in which sole plate 18 lies. The above-discussed rotation of trigger 17, and the corresponding translation of movement to other elements within gear box 42, causes platform surface 40 to move in a direction that is substantially perpendicular to the plane of sole plate 18. In other words, at all times throughout rotation of trigger 17 and the corresponding movement of platform surface 40, platform surface 40 remains in a plain that is substantially parallel to the plane in which sole plate 18 lies. In other embodiments, platform surface 40 and sole plate 18 may lie in initial planes which are not substantially parallel to each other. Rather, platform surface 40 and sole plate 18 may initially be in non-parallel planes, but upon being closely juxtaposed or upon touching each other, platform surface 40 and sole plate 18 enter substantially parallel planes. Various initial positions and subsequent transition positions are contemplated throughout the movement of platform surface 40 with respect to sole plate 18.

FIG. 7 shows iron 10 in an initial position with platform 14 displaced from housing 12 by a distance x. In this position it is possible to insert an article of fabric between housing 12 and platform 14. Actuator 16 facilitates movement of platform 14 with respect to housing 12, and upon actuation of trigger 17, platform 14 moves towards housing 12, thereby clamping any article of fabric located therein. This second position is best shown in FIG. 8. As discussed above, the movement of platform 14 with respect to housing 12 occurs in a direction that is substantially perpendicular to the substantially parallel planes of sole plate 18 and platform surface 40 respectively. At all positions between the initial position and the second position, the sole plate 18 and the platform surface 40 remain in substantially parallel planes with respect to one another. This allows for substantially uniform pressure to be applied to the article of fabric along its surface. It is contemplated that in other embodiments, sole plate 18 and platform surface 40 may initially be in non-parallel planes with respect to one another, but when closely juxtaposed or when sole plate 18 and platform surface 40 touch, they become substantially parallel to one another. It is also contemplated that iron 10 can be configured so that the above discussed initial position can be that which is shown in FIG. 8. In this embodiment, actuation of trigger 17 would displace platform surface 40 away from sole plate 18.

While in the preferred embodiment platform surface 40 contacts sole plate 18 upon actuation of trigger 17 (best shown in FIG. 8), it is also contemplated that complete actuation of trigger 17 may not result in platform surface 40 being in contact with sole plate 18. Rather, a small distance would still remain between sole plate 18 and platform surface 40. Finally, it is noted that operation of iron 10 does not require that trigger 17 be completely rotated or actuated. A user can vary the amount of movement of platform surface 40 with respect to sole plate 18, by selectively rotating trigger 17. Preferably, a single stroke of trigger 17 provides the requisite translation of platform 14 to move platform surface 40 against sole plate 18.

Figure 9:
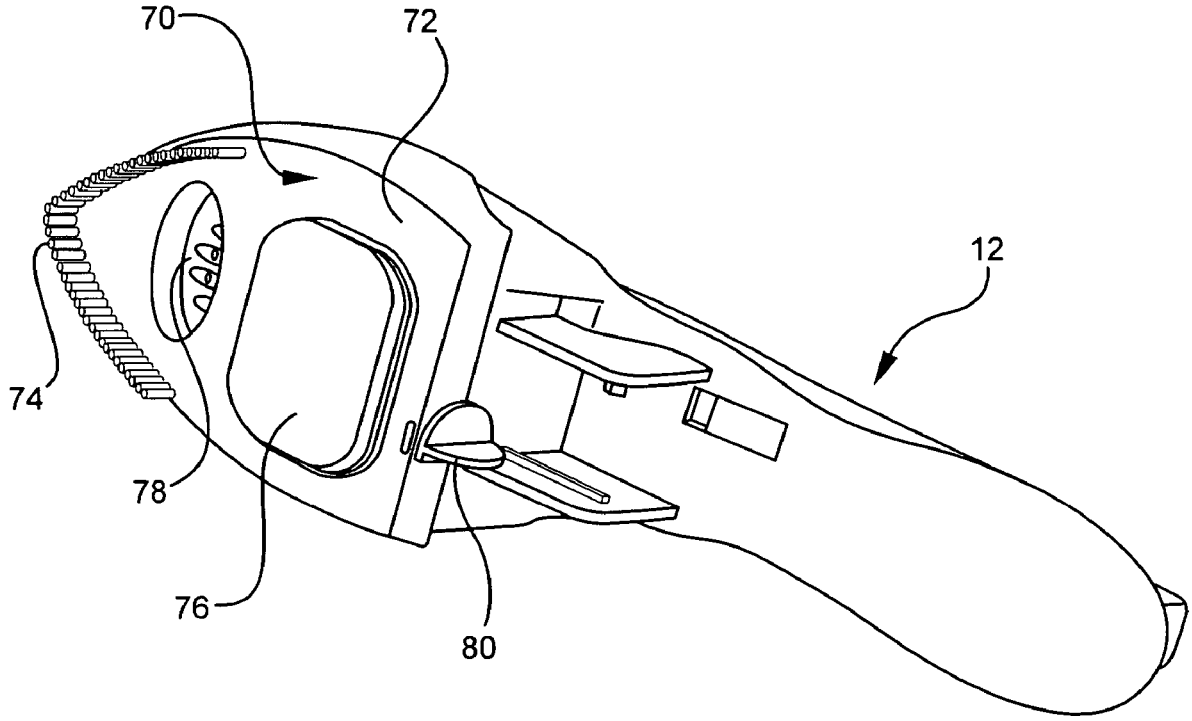
FIG. 9 is a bottom perspective view of the apparatus according to an embodiment of the present invention with a brush attachment connected to the housing.
Figure 10:
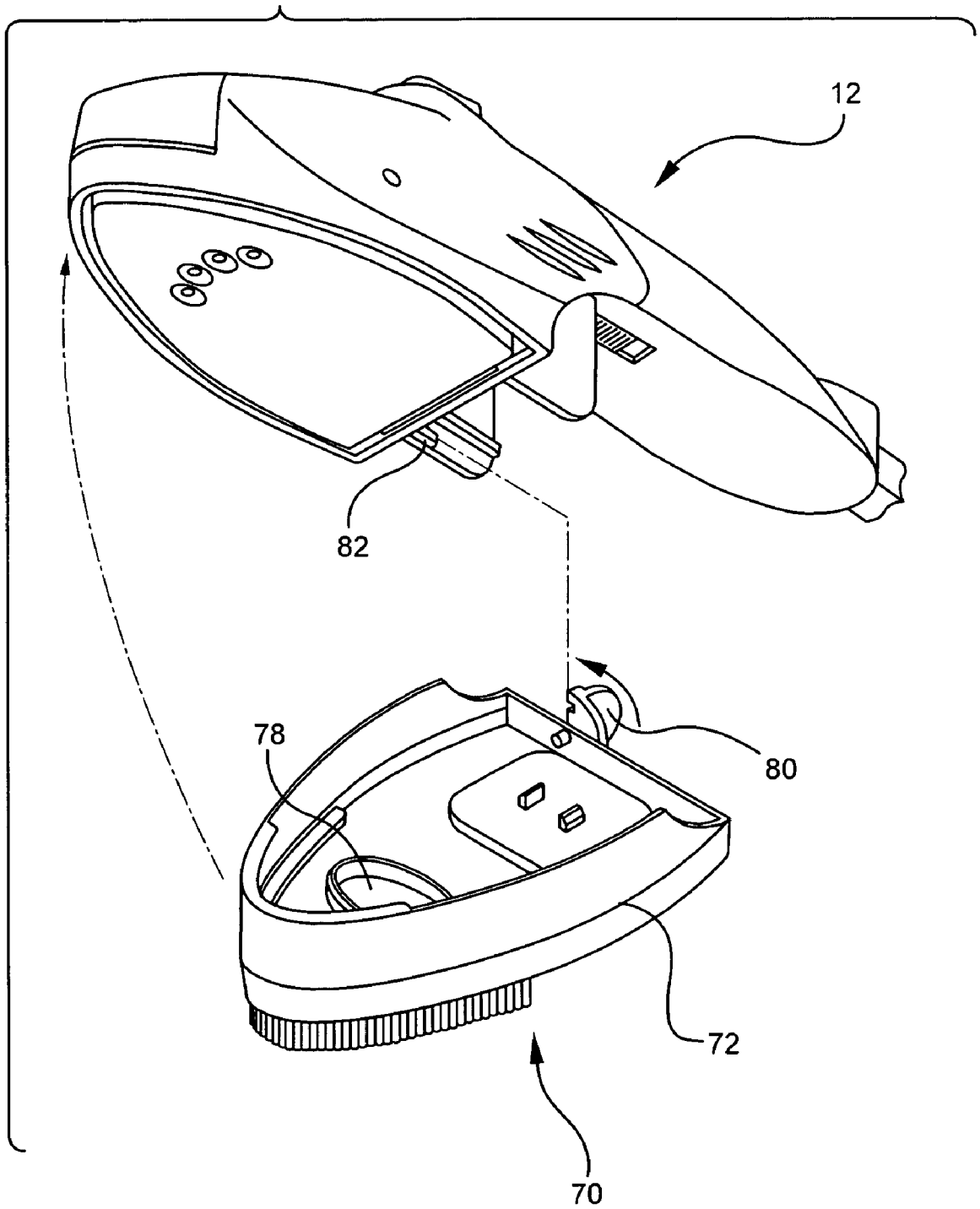
FIG. 10 is an exploded bottom perspective view of the apparatus according to the embodiment of FIG. 9 showing the housing and the brush attachment.

FIGS. 9 and 10 show the relationship between brush attachment 70 and housing 12 from which platform 14 and actuator 16 have been removed. FIG. 9 shows brush attachment 70 attached to housing 12, while FIG. 10 shows an exploded view of the brush attachment 70 and housing 12. Brush attachment 70 is useful in steaming and removing lint or other debris from certain types of fabric. Brush attachment 70 includes body 72. Bristles 74, lint pad 76, steam aperture 78, and latch 80 are all situated on body 72. Bristles 74 are arranged in a substantially V-shaped configuration and aid in both the pressing of fabrics and removal of debris through steaming. While bristles 74 are shown in the V-shape, it should be noted that any configuration can be utilized. Lint pad 76 is useful in removing unwanted lint or other material from the surface of a fabric. Lint pad 76 is preferably constructed from a polyester material and more preferably a polyamide and cotton woven fabric, but can be other materials and/or configurations that are known in the art suitable for removing lint or other material from the surface of a fabric. Steam aperture 78 is a void in the surface of brush attachment 70 which aligns with apertures 20 of sole plate 18. Steam aperture 78 allows for steam produced by iron 10 to escape while brush attachment 70 is attached, and thereby aid in the pressing of a fabric. Finally, latch 80 secures brush attachment 70 to housing 12. Latch 80 is a circular lock which engages locking member 82 of housing 12 and prevents the dislodging of brush attachment 70 therefrom. It is contemplated that other types of locking means can be utilized in securing brush attachment 70 to housing 12. For example, brush attachment 70 could snap into place upon engagement with housing 12. While the preferred embodiment of brush attachment 70 is shown in FIGS. 9 and 10, other embodiments can include additional or fewer elements and can have elements which are configured differently.

Figure 11:
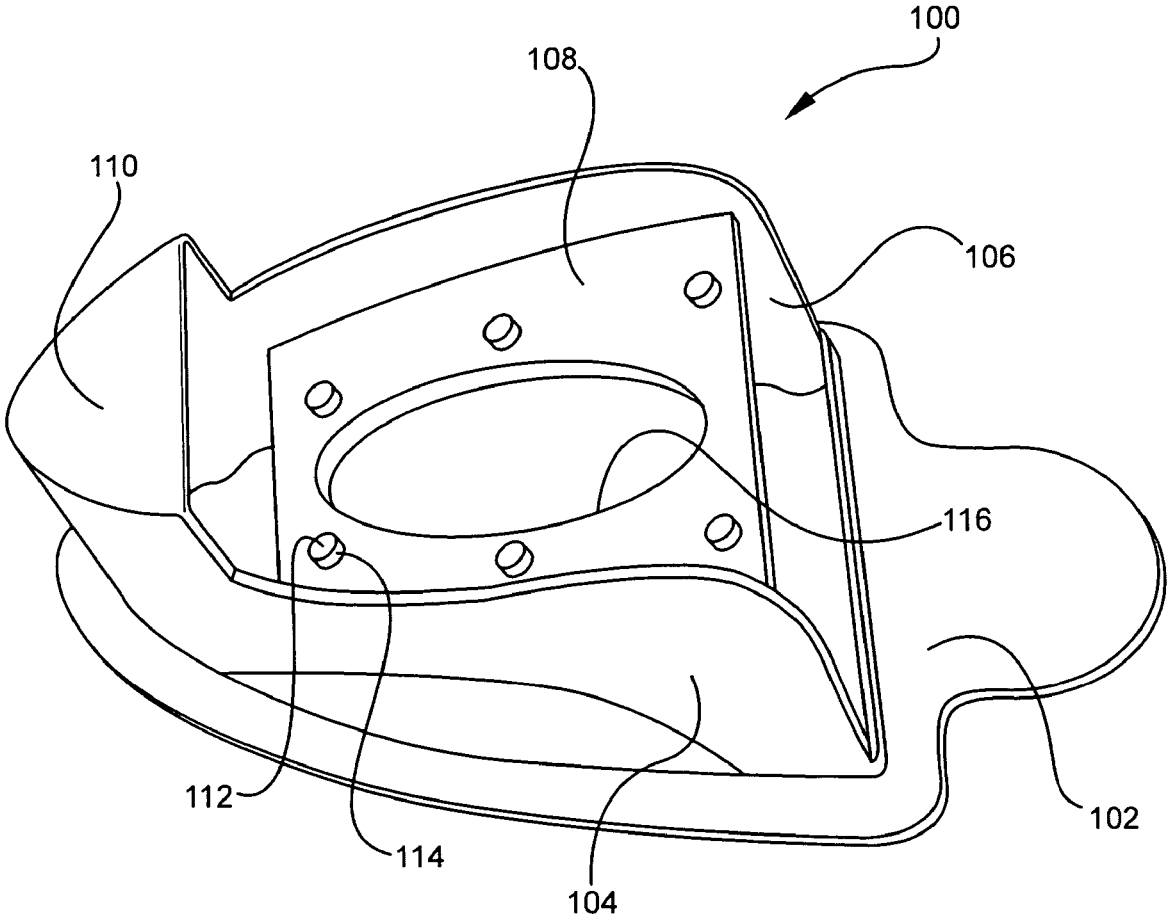
FIG. 11 is a top perspective view of the cradle according to an embodiment of the invention; and, FIG. 12 is a top perspective view of the cradle according to the embodiment of FIG. 11 with the iron resting in the cradle.
Figure 12:
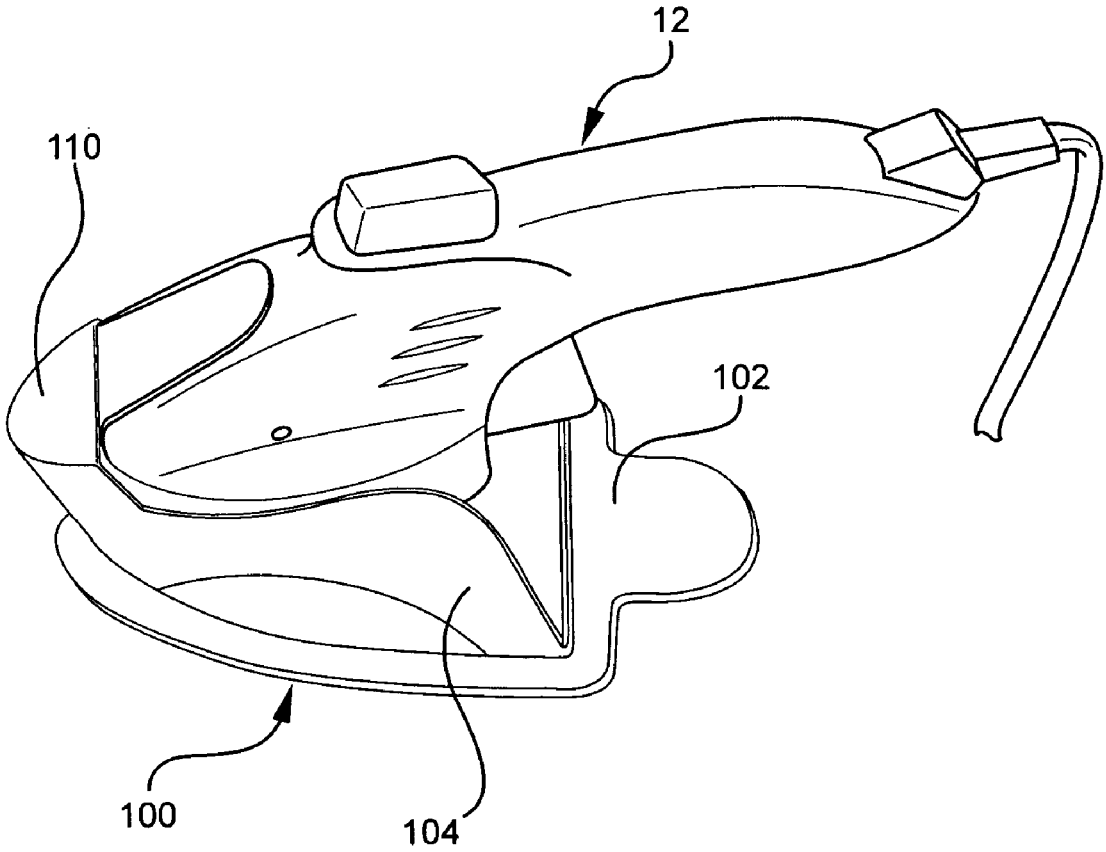

Finally, a preferred embodiment of the present invention includes a cradle 100 for capturing and holding iron 10. As shown in FIGS. 11 and 12, cradle 100 includes cradle foot 102, cradle legs 104 and 106, cradle base 108, and cradle stop 110, all of which are constructed of a polymeric material. Cradle foot 102 rests on a support surface, while cradles legs 104 and 106 connect cradle base 108 and cradle stop 110 to cradle foot 102. Cradle base 108 includes a plurality of raised fingers 112 seated in holes 114 thereon. Additionally, cradle base 108 includes a large aperture 116 in a substantially center portion. In use, iron 10, either with or without platform 14 and actuator 16 connected thereto, is placed so that sole plate 18 of housing 12 is situated in direct contact with raised fingers 112 of cradle base 108. Raised fingers 112 are constructed of high temperature rubber which will not melt when subjected to the heat produced by sole plate 18. Additionally, aperture 116 of cradle base 108 allows for heat to be vented away from cradle base 108, thereby further reducing damage of cradle 100 from occurring upon being subjected to the heat of sole plate 18. As shown in FIG. 12, a portion of housing 12 is disposed within cradle stop 110 so that housing 12 is secured to cradle 100. Cradle 100 can be utilized in conjunction with iron 10 to hold such while in non-use or while sole plate 18 is heated to a desired temperature. In other embodiments, it is contemplated that the elements of cradle 100 can be of any size or shape for receiving iron 10. Further, it is contemplated that cradle 100 can be constructed of different materials. For example in other embodiments, cradle 100 is constructed substantially of metal. Finally, it should be noted that iron 10 can be completely utilized without the use of cradle 100. For example, the heating of sole plate 18 to a desired temperature can be performed while holding iron 10, placing iron 10 on its side, or supporting iron 10 with platform 14, among others.

The preferred embodiment of the present invention is shown in FIGS. 1–12, however, other embodiments are contemplated. It is contemplated that the various elements of iron 10 can be different shapes for performing different types of pressing. For example, sole plate 18 and platform surface 40 can be of varying size and/or shape depending upon the size and type of material to be pressed. A larger surface area can be utilized to press more material at any given time. It is contemplated that platform 14 can be interchangeable to allow for different platform surfaces 40 to be utilized depending upon the type of job to be performed. Similarly, iron 10 can be configured so that interchangeable sole plates of varying size and shape can be utilized. Iron 10 can also include a thermostat or other temperature control system for better controlling the temperature of the heating element and sole plate 18. It is also contemplated that iron 10 can be configured to allow use with different voltages. In this embodiment, iron 10 may include an adapter or other device that facilitates iron 10 to be multi-voltage. Furthermore, iron 10 can be equipped with a safeguard that shuts down the heating element upon a certain period of nonuse. Such a safety device prevents common forgetfulness from resulting in disaster.

Another aspect of the invention relates to a method for utilizing a handheld ironing device. A method according to a preferred embodiment of the present invention includes utilizing a handheld ironing device, such as the iron 10 discussed above, to press an article of fabric without the use of an ironing board. It is noted that the above discussed iron 10 can be configured so as to allow for its use with a separate ironing board. Furthermore, as shown above, it is also possible for iron 10 to be configured to operate in conjunction with brush attachment 70 to facilitate the removal of lint or other debris.

In a preferred embodiment of the method of the present invention, the preferred iron 10, as discussed above, is employed. The user plugs power cord 30 into a standard wall socket and allows sole plate 18 to acquire a desired temperature level. A signal that sole plate 18 has reached the desired temperature level may be included. Upon reaching this desired temperature, a wrinkled fabric article is selected (although non-wrinkled fabrics for which a user wishes to form a crease in can also be utilized). A portion of this fabric article is placed between sole plate 18 and platform surface 40. Trigger 17 is then actuated towards elongated handle 22. In the preferred embodiment, a user can grasp iron 10 with one hand, while actuating trigger 17 with a finger of the same hand. This allows for easy manipulation of iron 10 and gives the user freedom of his/her other hand. Actuation of trigger 17 causes platform 14 and platform surface 40 to displace towards sole plate 18, thereby clamping the article of fabric therebetween. The amount of actuation of trigger 17 directly determines the amount of displacement of platform 14. In turn, the pressure applied to the article of fabric may vary depending upon the amount of actuation of trigger 17. As stated above, sole plate 18 and platform surface 40 are initially in substantially parallel planes, and relative movement of platform surface 40 occurs in a direction substantially perpendicular to these planes. Therefore, substantially uniform pressure can be applied to the fabric article clamped therebetween.

Upon achieving the desired pressing of the fabric material (which may take some time, or multiple actuations of trigger 17), the user releases trigger 17, which is automatically biased to its original position, thereby returning platform 14 and platform surface 40 to their respective original positions. In these positions, the portion of the fabric article can be removed and additional portions of the article can be pressed. This process can be successively performed until all portions of the fabric article are pressed or all desired areas are creased. Additionally, at any time during the operation of iron 10, a user may selectively press button 38 to produce a desired amount of steam. Such steam may aid in pressing process. Button 38 is preferably situated so that a finger of the one hand of the user can be used to press it. Finally, a user may remove platform 14 and actuator 16 from housing 12, by biasing switch 26 and sliding gear box 42 from slot 24. With platform 14 and actuator 16 removed from housing 12, brush attachment 70 can be placed on housing 12. This attachment can be utilized to remove lint or other debris, or to simply steam an article of fabric through the operation of button 38. It should be noted that housing 12, with platform 14 and actuator 16 removed therefrom, can also be utilized in a manner similar to that for which conventional irons are utilized. A method of this type is well known in the art.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of removing wrinkles from fabric comprising:

providing a handheld ironing device having a heating surface, a platform surface opposed to the heating surface, and an actuator for moving said platform with respect to said body portion, said actuator including a trigger, a spring, and a gear assembly which are assembled to maintain said platform in an initial position, where the heating surface and the platform surface are substantially continuous and substantially flat surfaces;

situating a fabric article between the heating surface and the platform surface; and, moving the platform and heating surfaces together by actuating the trigger to press the fabric article with substantially uniform pressure between the heating surface and the platform surface.

2. The method of claim 1, further comprising the step of heating the heating surface to a desired temperature.

3. The method of claim 1, wherein said moving step further comprises actuating an actuator to move the platform surface with respect to the heating surface while the platform surface and the heating surface remain in parallel planes throughout movement.

4. The handheld ironing device of claim 1, wherein said actuator is associated with said body portion and said platform to move said platform between a closed position at which said platform is closely juxtaposed to or touching said body surface and an open position at which said platform is separated from said body surface sufficiently to allow insertion of fabric between said platform and said body surface.

5. The method of claim 1, further comprising the step of producing steam.

6. The method of claim 5, wherein said step of producing steam comprises providing a liquid and selectively heating said liquid to a gaseous state.

7. The method of claim 1, further comprising the step of removing lint or other debris from the fabric article.

8. The method of claim 7, wherein said step of removing lint or other debris from the fabric article requires the addition of an attachment to said handheld ironing device.

9. A handheld ironing device comprising:

a body portion having a substantially continuous and substantially flat heating surface;

a platform having a substantially continuous and substantially flat platform surface, said platform moveably associated with said body portion;

an actuator for moving said platform with respect to said body portion, said platform and said actuator capable of being removed from said body portion; and a removable brush attachment capable of being connected to said body portion upon removal of said actuator and said platform.

10. The handheld ironing device of claim 9, further comprising a liquid container for facilitating the production of a gas.

11. The handheld ironing device of claim 9, wherein said actuator is associated with said body portion and said platform to move said platform between a closed position at which said platform is closely juxtaposed to or touching said body surface and an open position at which said platform is separated from said body surface sufficiently to allow insertion of fabric between said platform and said body surface.

12. The handheld ironing device of claim 9, wherein said actuator includes a trigger, a spring, and a gear assembly which are assembled to maintain said platform in an initial position.

13. The handheld ironing device of claim 9, further comprising a thermostat for controlling the temperature of said heating surface.

14. A handheld ironing device comprising:

a body portion having a substantially continuous and substantially flat body surface;

a platform having a substantially continuous and substantially flat platform surface, said platform moveably associated with said body portion such that said platform surface opposes said body surface and such that said body surface and said platform surface remain in substantially parallel planes throughout movement of said platform with respect to said body portion; and an actuator for moving said platform with respect to said body portion, said actuator including a trigger, a spring, and a gear assembly which are assembled to maintain said platform in an initial position.

15. The handheld ironing device of claim 14, wherein operation of said trigger facilitates movement of said platform from said initial position a first distance adjacent to said body portion to a second position a second distance adjacent to said body portion, said first distance being greater than said second distance.

16. The handheld ironing device of claim 15, wherein said platform surface contacts said body surface in said second position.

17. The handheld ironing device of claim 14, wherein operation of said trigger facilitates movement of said platform from said initial position a first distance adjacent to said body portion to a second position a second distance adjacent to said body portion, said first distance being less than said second distance.

18. The handheld ironing device of claim 17, wherein said platform surface contacts said body surface in said first position.

19. The handheld ironing device of claim 14, wherein said actuator is removable from said body portion.

20. The handheld ironing device of claim 19, wherein said actuator and said platform are removable from said body portion.

21. The handheld ironing device of claim 20, further comprising a removable brush attachment, wherein said brush attachment may be connected to said body portion upon removal of said actuator and said platform.

22. The handheld ironing device of claim 14, wherein one of said body surface or said platform surface is a heating surface.

23. The handheld ironing device of claim 22, wherein said body surface is a heating surface and said body portion further includes a heating element adapted to transfer heat to said heating surface.

24. The handheld ironing device of claim 23, further comprising a thermostat for controlling the temperature of said heating surface.

25. The handheld ironing device of claim 23, wherein said heating surface is a sole plate connected to said heating element.

26. The handheld ironing device of claim 25, further comprising a water reservoir for providing water to said heating element to facilitate the production of steam.

27. The handheld ironing device of claim 26, wherein water may be selectively provided to said sole plate.

* * * * *